US005662423A

United States Patent [19]

Walden

[11] Patent Number: 5,662,423

[45] Date of Patent: Sep. 2, 1997

[54] GRIPPING AID FOR WRITING IMPLEMENTS

[76] Inventor: Deitra G. Walden, 10908 Montrose Ave., Temple Terrace, Fla. 33617

[21] Appl. No.: 670,407

[22] Filed: Jun. 25, 1996

[51] Int. Cl.[6] ..... B43K 31/00; B43K 23/00

[52] U.S. Cl. ..... 401/7; 15/437; 15/443; 401/8; 434/166

[58] Field of Search ..... 401/7, 8; 15/437, 15/443; 434/166

[56] References Cited

U.S. PATENT DOCUMENTS

| | | | |
|---|---|---|---|
| D. 362,681 | 9/1995 | Jones et al. | 401/8 X |
| 371,814 | 10/1887 | Bearce | 15/437 |
| 488,945 | 12/1892 | Nelson | 401/7 |
| 2,273,044 | 2/1942 | Johnson | 401/8 |

FOREIGN PATENT DOCUMENTS

| | | | |
|---|---|---|---|
| 158264 | 8/1954 | Australia | 401/8 |
| 51299 | 3/1910 | Switzerland | 15/443 |

*Primary Examiner*—Steven A. Bratlie
*Attorney, Agent, or Firm*—Dominik & Stein

[57] ABSTRACT

A proper writing grip may be achieved by utilizing a conic shaped gripping aid which is slidably positioned along the barrel of a writing implement and comprises a finger retaining strap upon its lower surface. The gripping aid is durable due to the one piece design, economical to produce, easy to use and has no sharp edges or rigid members.

11 Claims, 3 Drawing Sheets

GRIPPING AID FOR WRITING IMPLEMENTS

BACKGROUND OF THE INVENTION

1. Field of the Invention

The present invention concerns a device and method for gripping a writing implement and learning correct penmanship, and in particular, to a device which slides over a writing implement and aids in aligning an individual's fingers into proper orientation for holding a writing implement. The gripping aid is durable due to the one piece design, economical to produce, easy to use and has no sharp edges or rigid members.

2. Description of the Related Art

Children should be prepared to learn from the first day of school, knowing how to write and properly hold a writing implement is an important step in a child's educational development. Specifically, writing will be an important skill from first-grade through college and throughout adulthood. In addition to scholastic importance, coloring, drawing and writing allow a child to enjoy self-expression and become more self-reliant.

Children often start coloring at a very early age and may spend endless hours coloring and learning to draw. Coloring can be an especially important activity for preschool and very young children. Specifically, young children need materials and activities through which they can express their ideas and feelings which do not have a "predetermined" outcome. They need creative materials which by their nature, are nonrestrictive. Therefore, parents should and often do encourage their young children to draw and attempt coloring activities. However, there can be disadvantages to a child attempting to draw or color at too early an age. While a toddler may have expressed an interest in coloring activities this does not mean the child has the manual dexterity, coordination nor physical strength to properly hold a writing implement such as a crayon. Therefore, in order to draw, a child will grasp a crayon in an incorrect manner.

By the time a child attains the interest, coordination skills and physical strength needed to begin writing properly, they have established and reinforced poor habits of how to hold a crayon or pencil. Incorrect practices for holding a coloring or writing implement can be observed in children as young as 2½ years old. Young children tend to incorrectly hold their coloring/writing implement in several distinct ways, most notably they clutch the barrel of the writing implement in their fist, exert unnecessary downward pressure and move the entirety of their arm in an exaggerated motion.

While this grip may seem comfortable to a young child, and enables a child to color, continued use of this type of grip can not only impede learning correct penmanship but cause premature wear and tear on crayons. When a young child clutches a crayon in his fist, rather than in a proper grip, there is a tendency for the child to exert too much downward pressure. As a result the crayon wears quickly and unevenly or breaks into small pieces.

Given the importance of a proper grip and writing technique to successful writing, numerous attempts have been made over the years to perfect a device to aid in the proper positioning of an individual's fingers upon a writing implement. Generally speaking, these devices have either been for writing aids which provide a "gripping surface" into which the user presses his fingers or writing aids which include a "sleeve" which encase one or more of the digits of the user. However, devices utilizing either of these approaches have inherent drawbacks which have prevented their acceptance.

For instance, U.S. Pat. No. 2,416,953 (Tizio) teaches a metal guide holder for writing instruments. Specifically, the device of Tizio comprises a sheet metal body having a annular coil for engaging about one's finger which connects at right angles with a section having tubular socket for engaging a pencil or other writing implement. While it is intended that the middle finger (hereinafter third finger) of the user's hand engages through the annular coil, there is no mechanism to properly orient the user's thumb or index (hereinafter second) finger. Additionally, the device of Tizio is manufactured of metal and includes sharp angles.

U.S. Pat. No. 5,310,345 to Gershon teaches a writing aid for both left and right-handed persons. The device of Gershon includes a central section having a first side and a second opposite side and a means which receives and hold an elongated writing instrument between the first and second sides. A first sleeve is attached to the central section and defines a finger-receiving first pocket. Similarly, a second sleeve is attached to the second side of the central section and defines a second finger receiving pocket.

The sleeves and associated pockets are configured and dimensioned to be angularly offset with respect to one another in such a manner that the user's thumb may be inserted into one of the finger-receiving pockets and the user's index finger may be inserted into the other finger-receiving pockets. However, the device to Gershon is too complex for a young child to comprehend the proper orientation of the device upon a writing implement, only positions the thumb and index fingers without orienting the remaining fingers, and prevents the user from having any physical contact with the writing implement itself.

Similarly, U.S. Pat. No. 3,019,769 to Ballard teaches a writing aid which seeks to "improve writing" by immobilizing the fingers of the user. The device of Ballard comprises a cylindrical plastic sleeve which slidably receives a writing instrument and comprises rearwardly divergent thumb and index finger stalls which are formed integrally with the plastic sleeve. The stalls are provided with cavities shaped to received the end of the thumb and the end of the index finger of the writer. Additionally, the cylindrical plastic sleeve has a metallic liner mounted in the sleeve comprising anchoring teeth which are adapted to bite into the writing instrument. The device to Ballard contains metal components, is too complex for a young child to comprehend the proper orientation of the device upon a writing implement, only positions the thumb and index fingers without orienting the remaining fingers, and prevents the user from having any physical contact with the writing implement itself.

U.S. Pat. No. 1,702,660 to Mockel teaches a device which is designed to ensure proper finger-position for writing. The device of Mockel is not directly connected with the writing implement, rather the device is intended to retain only the fingers in a determined position. The device of Mockel consists of an adjustable sleeve, this sleeve is pushed over the second finger of the user, and serves as a "carrier" for an S-shaped clamp. One hook-shaped end of the clamp is designed to be placed over the third finger while the other end serves as support for the thumb. In use, the writing instrument rests freely between the tip of the thumb and the second and third fingers. The device of Mockel contains sharp edges, is structurally complex and does not educate the user how to properly support the writing instrument upon the third finger.

U.S. Pat. No. 4,832,604 to Rusk exemplifies an alternative approach to orienting an individual's grip upon a writing instrument. The device of Rusk includes a body having a central bore for receiving the writing instrument and an exterior surface having three arcuate gripping surfaces positioned for receiving the users first, second and third fingers. Additionally, the device of Rusk includes a upper and lower arcuate gripping rings formed on the cylindrical wall which are provided for gripping a pencil. In use, an individual places the device anywhere along the barrel portion of a writing implement and positions their fingers upon the gripping surfaces. The device of Rusk provides no support to retain the third finger in proper orientation and does not permit the user any direct contact with the writing implement. See also U.S. Pat. No. 4,167,347 (Hoyle) and U.S. Pat. No. 5,143,463 (Ponzil et al.).

Simply stated, devices currently available to "teach" proper writing technique are largely intended for adult use rather than pre-school aged children. A parent wishing to help their child learn proper finger placement on a writing implement, utilizing the writing aids currently available, would be required to constantly monitor the child to ensure the child's safety and that the child's fingers had not "slipped" from the writing implement.

In order to prevent children establishing bad habits while using a writing implement, it is important to teach and reinforce the skill of properly holding and using a writing implement from the moment a child first picks up and uses a crayon even though the child may not have the physical strength or coordination for the task. For the foregoing reasons, there is a need for a simple, flexible device which aligns a user's fingers into a proper writing position.

SUMMARY OF THE INVENTION

In view of the foregoing disadvantages inherent in the current devices used to retain or orient an individual's fingers upon a writing implement it is the object of the present invention to provide an economical, efficient, and simple-to-use device by means of which an individual's fingers are properly aligned and maintained upon a writing implement.

It is a further object to provide a gripping aid which orients the second finger on the top surface of the writing implement and urges the second finger to apply correct pressure onto the writing implement.

It is a further object to provide a gripping aid which orients the third finger into a proper position under the writing implement, rather than along side the writing implement or on top of the writing implement to aid in balance and control.

It is a further object to orient the fingers of the user and reinforce correct placement of the thumb upon the writing implement while retaining the fingers in proper placement without undue effort.

It is a further object to allow direct contact between the second finger and the writing implement. Contact between the index finger and the writing implement provides the user with a feel for the writing implement and how it should be held.

It is a further object to provide a writing aid which may be sized to accommodate different sized fingers and varying sized writing implements.

It is a further object to provide the writing aid with orientation indicia such that the writing implement may be utilized by either a right- or left-handed child.

It is a further object to provide a method designed to teach and provide positive reinforcement to young and school-aged children in their first attempts to hold and use a writing implement.

It is a further object of the present invention to provide a gripping aid which is economical to produce, durable, and of simple construction.

The foregoing has outlined rather broadly the more pertinent and important features of the present invention in order that the detail description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other gripping aids for writing implements for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

Further objectives and advantages of the present invention will become apparent from a careful reading of the detailed description provided hereinbelow, with appropriate reference to the accompanying drawings.

DETAILED DESCRIPTION OF THE INVENTION

Figure 1:
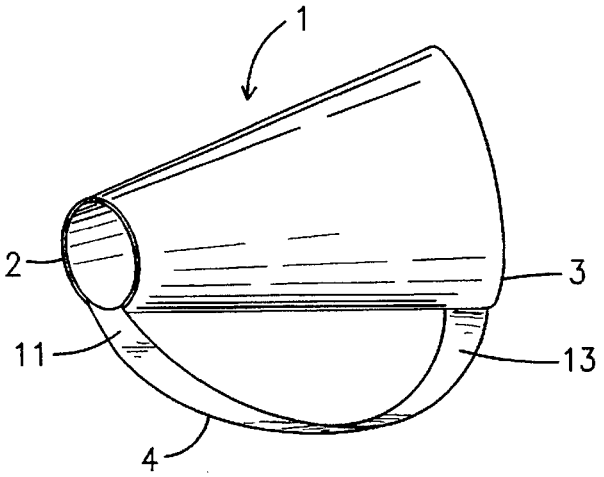
FIG. 1 is a perspective view of the gripping aid of the present invention.

After extensive investigation, the present inventor has discovered that a proper writing grip may be achieved by utilizing a conic shaped gripping aid which is slidably positioned along the barrel of a writing implement and includes a finger retaining strap upon its lower surface.

Many children find it difficult to correctly hold a writing implement and apply accurate pressure while coloring, drawing and writing. Children find it difficult to place and keep their third finger beneath the writing implement, allowing the third finger to support the writing implement, while maintaining the second finger on the top surface of the writing implement. Children also find it difficult to maintain the writing implement in a near parallel position to the second finger.

The present invention has extensively studied the development of writing habits in children, and has determined that several factors seem to contribute to make it difficult for a child to hold a writing implement correctly and sufficiently. One factor involves a child's muscular ability to hold, direct and apply proper pressure to a writing implement. A second factor encompasses a child being able to overcome a tendency to utilize an incorrect, albeit comfortable, writing grip or break an established incorrect way of gripping a writing implement. A third factor involves a child's ability to remember and replicate the correct placement of their fingers and thumb upon a writing implement.

The present invention also determined that young children tend to incorrectly grip their writing implement in several distinct ways:

1. The thumb and second (index) and third (middle) fingers encase the side of the writing implement;

2. The thumb and second, third and fourth fingers encase the top and sides of the writing implement;

3. The hand and all fingers encase the writing implement (i.e. the crayon is held in a fist); and 4. The thumb and second and third fingers encase the top and sides of the writing implement while the fourth finger is placed underneath the writing implement.

Additionally, children often hold the writing implement in an upright orientation rather than a slanted orientation. Alternatively, a child may have their thumb touching any spot along the second finger and completely not touching the writing implement, or have their thumb and second finger touching each other rather the writing implement.

Currently, there is not a writing grip or aid available which orients the third finger beneath the writing implement and supports the third digit in the correct position thereby eliminating the tendency to incorrectly grasp a writing implement in the aforementioned ways.

The device of the present invention is designed to facilitate the teaching of proper penmanship and reinforce proper writing techniques. Simply recognizing the proper placement of the fingers upon a writing implement is not sufficient to ensure a proper grip, balance or pressure. The device of the present invention addresses and solves more of the factors which inhibit a child from learning correct penmanship than any like devices currently patented. Through its design the present invention provides proper finger placement, pressure, balance and the feel of a writing implement in correct orientation. In addition, the present invention reinforces coordination skills by helping a child's grip on a writing implement to stay in place. Lastly, since the present device is simple in construction, simple to use and contains no sharp edges a child is more likely to utilize the device.

The gripping aid of the present invention is structurally and mechanical rudimentary. The gripping aid is constructed roughly in the shape of a cone, having a tapered central bore defined therethrough. More specifically, the gripping aid of the present invention is a truncated right circular cone with the truncation plane parallel with the base. Joined integrally with this frustoconical body is a pliable strap which serves to retain the third finger beneath the writing implement.

The use of the gripping aid will now be explained in greater detail.

To position for use, the gripping aid of the present invention is simply inserted over the barrel of a writing implement to the desired location. The user (with an initial demonstration, and thereafter with or without parental supervision) horizontally holds the tip of a writing implement with the attached gripping aid in the users non-dominate hand. The user then inserts the third finger slightly through the strap coupled to the cone shaped portion of the gripping aid. The user then inserts the second finger into the larger base portion of the cone shaped gripping aid. Next or simultaneously the thumb is placed on the external surface of the gripping aid alongside the writing implement.

When the gripping aid is properly oriented on a writing implement, the smaller first end of the cone shaped portion is nearer to the writing tip of the writing implement.

Placement of the second finger inside the cone is no longer necessary when the child demonstrates the ability to keep the second finger and thumb from slipping off the writing implement and exerts proper pressure on the writing implement while using it. The child is then encouraged to place his thumb and second finger on the external surface of the cone-shaped gripper as well as continuing to insert the third finger through the strap.

In an alternative embodiment, the gripping aid additionally comprises surface indicia which aid a child in orienting their thumb (and later their second finger) on the external surface of the gripping aid. Preferably, the surface indicia is applied through a printing process such that it is durable and non-toxic. Alternatively, as taught by U.S. Pat. No. 4,832,604 (Rusk), the disclosure of which is incorporated herein by reference, the surface indicia may be formed by engraving a reverse character into a mold from which the writing aid is made, so that when the writing aid emerges from the mold, the surface indicia will be formed as a part of the gripping surface.

In a preferred embodiment, the surface indicia comprises a circular character (with or without the center being filled-in). However, the surface indicia is not limited to a circular character and may be a star or any easily recognized symbol. As a further refinement to the present invention, the gripping aid may include a direction indicating means for indicating the proper placement of the aid on a writing implement.

The present invention is dimensioned to permit the easy insertion of a crayon in the cone by a child. The gripping aid of the present invention may be manufactured in multiple sizes depending on the size of the writing implement to be utilized. Ideally, the present invention should be sized such that the writing implement inserted therethrough, i.e. a crayon, pencil or marker, stays stationary when the gripping aid is in use, but have enough leeway for the child to slide the gripping up and down the writing implement. Specifically, the gripping aid slips over but does not attach to the writing implement. It is held in place by: the thumb, second and third finger.

Since a major difficulty for young children is learning to position and keep in place the third finger below the writing implement. This device is unique in that it establishes a means in which the third finger is placed in a stationary position. The strap beneath the cone allows proper placement of the third finger as well as proper grip and balance. Additionally, the cone shaped design compels the second finger and the thumb to press together while allowing direct contact with the writing implement itself. Lastly, the gripping aid has a simplistic design such that it can be utilized by a small child without adult supervision.

A further advantage of the gripping aid of the present invention is that a child does not obscure the writing tip of the writing implement due to an incorrect grip. More precisely, a child will not have to move his head (i.e., lay their head on the table) in order to visualize the writing surface.

The gripping aid can be neutral, transparent, or manufactured in bright colors to coordinate with crayon colors. Additionally, different colors could be used to encode different sizes of gripping aids to facilitate selecting of the proper sized gripping aid for the writing implement (i.e., gripping aids sized for giant sized crayons to pencils). Further, gripping aids of small size can be easily misplace or lost by a child, and bright coloring may make misplaced gripping aids easier to find.

It is another object of the present invention to provide a gripping aid constructed of injection moldable thermoplastic for the advantages of the above benefits and economical production thereof. If manufactured from thermoplastic the gripping aid can be made by injection molding, extrusion, or any method of manufacture known in the art.

The gripping aid is preferably injection molded from a durable resilient plastic material, preferably a plastic material which has received U.S. Food and Drug Administration approval for use in connection with food (in that young children are prone to putting objects in their mouths). One suitable plastic material is polypropylene but other polyolefins may be used, such as a high density polyethylene copolymer, HiD 9118, sold by Chevron or the like, polybutylene and flexible PVC compounds containing plasticizers to soften the resin. One advantage of using a resilient plastic material is to facilitate the introduction and removal of the gripping aid of the writing implement. However, any suitable material may be used for the gripping aid including coated paper, fabric, rubber or the like. The gripping aid of the present invention can be hypo-allergenic, biocompatible and washable.

In an alternative embodiment, a surface indicia such as the outline of a circle may be applied to the gripping aid. These circles aid in positioning the fingers of the user, allows for use by a right or left-handed person or for use without inserting the second finger into the cone.

Paint and other coatings are applied to plastic surfaces by many different techniques. The choice of techniques is determined by the size and geometry of the plastic material to be coated, the type of coating used (especially its viscosity) and the coating thickness required.

Printing is the method most often used to coat plastic materials when ink or paint is deposited in small selected areas of a plastic surface and is a preferred application means in the present invention. Printing equipment may be categorized as screen printing, flexographic printing, gravure printing or pad printing. Preferably, the surface indicia will be applied to the gripping aid by means of pad printing. Use of pad printing allows for the application of the surface indicia on the small, irregularly shaped gripping aid. Pad printing equipment suitable for applying a surface indicia to a gripping aid are well known to those in the plastics and coating industries. See specifically, Berins, M. L. Ed., *Plastics Engineering Handbook of the Society of the Plastics Industry, Inc.*, 5th Edition N.Y. Van Nostrand Reinhold, 1991 pp. 787–792. ISBN 0-442-31799-9 incorporated herein by reference.

Alternatively, the surface indicia may be applied utilizing hot transfer processes such as hot stamping, laser marking or dyeing.

In a further refinement to the gripping aid of the present invention, the first end of the gripping aid may have a darkened band or block. This darkened band or block serves as an additional means for a young child to align the gripping aid upon a writing implement. Specifically, crayons such as CRAYOLA have a fanciful black designs on their packaging. In use, a child can simply slide the gripping aid of the present invention over the crayon until the black banded first end of the writing implement aligns with the fanciful border on the CRAYOLA. Once the banded end of the gripping aid and the black border of the CRAYOLA line-up, the young child will know that the gripping aid is in the proper position to begin use.

The device according to the present invention will now be discussed in greater detail by reference to the drawings.

Figure 2:
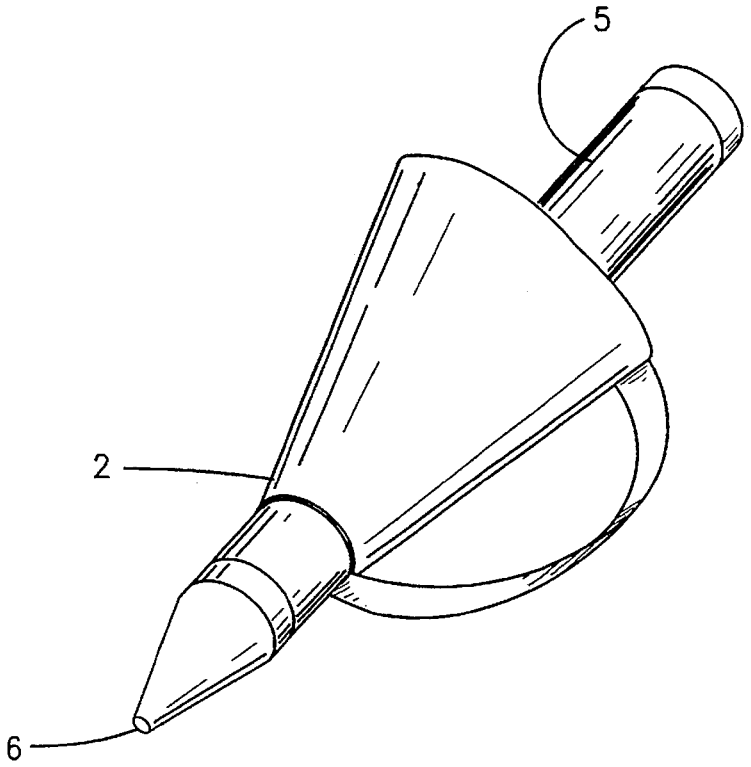
FIG. 2 is a perspective view of the gripping aid of the present invention and writing implement.

FIG. 1 illustrates a perspective view of the gripping aid 1 comprising a conic shaped tapered sleeve member 7 having a first open end 2 and a second open end 3. Coupled between the first end 2 and the second end 3 of the gripping aid is a strap 4, having a first end 11 and a second end 13 dimensioned to retain a finger therein. FIG. 2 illustrates the gripping aid properly positioned upon a writing implement 5. Specifically, the narrow first open end 2 is closer to the writing tip 6 of the writing implement. The diameter of the writing implement should be slightly smaller that the diameter of the first open end. The axial length of the conic member is preferably 1–2 inches, but should preferably always sufficiently cover the first bend in the finger of the user when in use. The width of the first and second ends of the gripping aid cannot be standardized because the width of the writing implement will greatly vary. Preferably, the width of the second end of the gripping aid is 1"–2"; more preferably, the width is 1"–1.5"; and most preferably, the width is about 1.25". The width of the second end of the gripping, however, will always be sufficient to encompass the barrel of the writing implement and the user's second finger.

Figure 3:
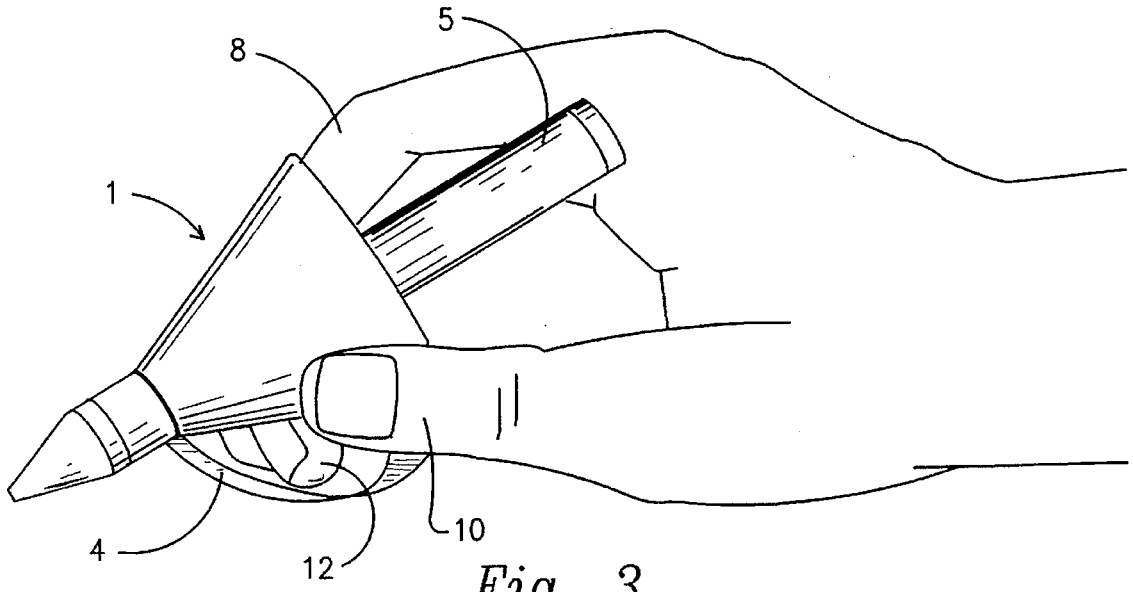
FIG. 3 is perspective view of the gripping aid of the present invention and writing implement with a user's hand.

FIG. 3 illustrates the gripping aid of the present invention in use. The conic shaped gripping aid 1 is positioned onto a writing implement 5, the user's second finger 8 is inserted into the wider second end 3 where it is retained against the writing implement. The user's thumb 10 is placed alongside the gripping aid while the third finger 12 is retained in the strap 4.

Figure 4:
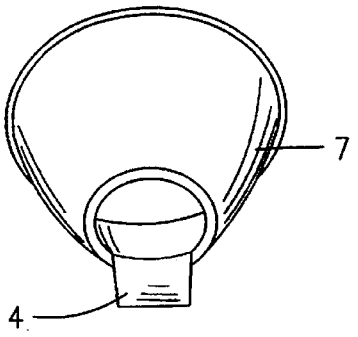
FIG. 4 is an end view of the gripping aid of the present invention.

FIG. 4 illustrates an end view of the gripping aid of the present device. The strap 4 may be integral with the conic shaped 7 portion of the gripping aid or it may be coupled by adhesives, sewing or by any means known in the art.

Figure 5:
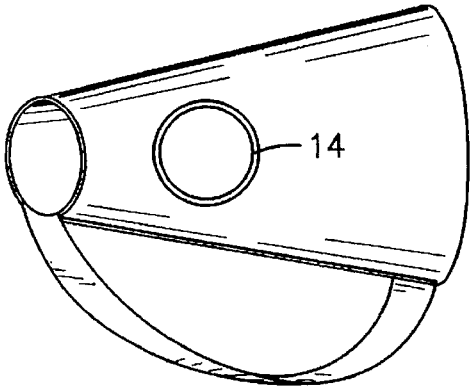
FIG. 5 is an alternative embodiment of the present invention illustrating surface indicia.
Figure 6:
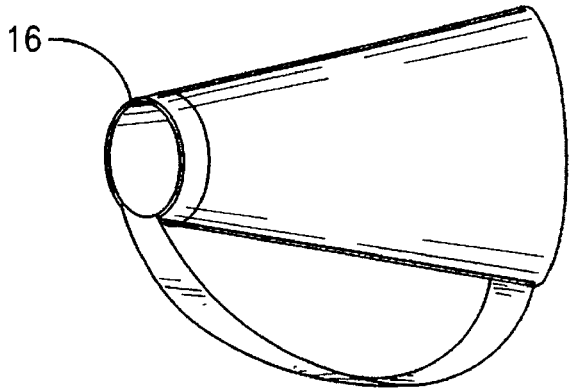
FIG. 6 is a second alternative embodiment of the present invention illustrating a positioning aid.
Figure 7:
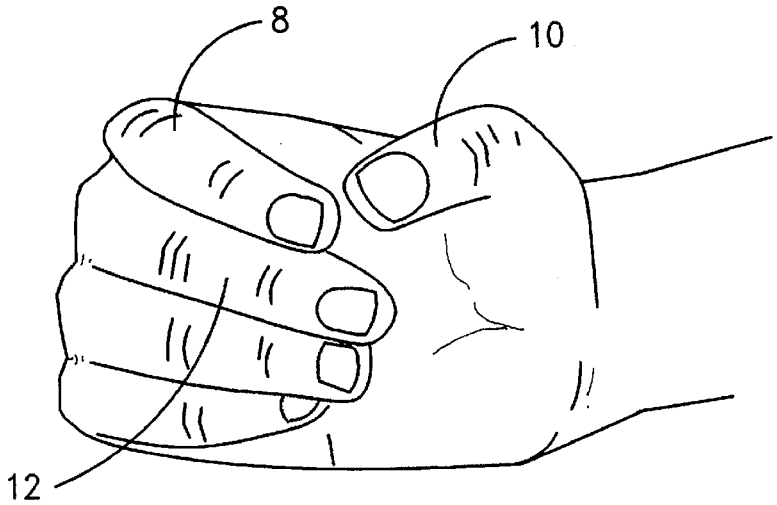
FIG. 7 is illustrative of an exemplary writing grip.

FIGS. 5 and 6 illustrate alternative embodiments of the gripping aid. Specifically, a surface indicia 14 may be utilized to help reinforce proper thumb placement upon the gripping aid. Alternatively, a band 16 may be incorporated to aid in positioning the gripping aid upon a writing implement. FIG. 7 illustrates an idealized grip where the third finger 12 is positioned below the writing implement (not shown).

Additionally, as a further refinement, the gripping aid 1 may have perforations extending through the tapered sleeve member. The perforations are sufficient in number to afford comfort to allow the user of the gripping aid to utilize the gripping aid for extended periods of time (i.e., several hours) without heat buildup or moisture accumulation within the tapered sleeve member or upon the hand. The perforations are preferably circular, and the diameter of the perforations is approximately 1/16"–1/4.

Although this invention has been described in its preferred form with a certain degree of particularity with respect to a gripping aid for a writing implement, it is understood that the present disclosure of the preferred form has been made only by way of example and that numerous changes in the details of structures and the composition of the system may be resorted to without departing from the spirit and scope of the invention.

Now that the invention has been described,

What is claimed is:

1. A writing implement gripping aid for teaching proper grip orientation, comprising:

a tapered sleeve member, having an external and an internal surface and a first open end and a second open end, wherein said tapered sleeve member is adapted to receive a writing implement there through and said second open end of said tapered sleeve member is dimensioned to retain the writing implement and second finger of a user therein; and a strap having a first end and a second end coupled to said tapered sleeve member, wherein said first end of said strap is coupled to said tapered sleeve member at said first open end and said second end of said strap is coupled to said tapered sleeve member at said second open end thereby defining an aperture between said strap and said tapered sleeve member, said aperture dimensioned to retain the third finger of a user therein, wherein said tapered sleeve member and said strap are oriented such that insertion of a writing instrument through the tapered sleeve member, insertion of the second finger of a user's hand into said second open end of said tapered sleeve member, placing the thumb of the user's hand upon the external surface of the gripping aid and inserting the third finger of the user's hand through said aperture defined by said strap to retain said third finger in said strap results in a proper writing grip.

2. A gripping aid as in claim 1, wherein said strap is formed integrally with the tapered sleeve member.

3. A gripping aid as in claim 1, wherein said tapered sleeve member includes surface indicia.

4. A gripping aid as in claim 3, wherein said surface indicia comprises a circle.

5. A gripping aid as in claim 3, wherein said surface indicia comprises a darkened band.

6. A gripping aid as in claim 1, wherein the axial length of the tapered sleeve member is about 1 to 2 inches.

7. A gripping aid as in claim 1, wherein said griping aid is constructed of a thermoplastic material.

8. A gripping aid as in claim 7, wherein said thermoplastic material is selected from the group consisting of polypropylene, polyethylene, polybutylene and polyvinyl chloride.

9. A method for using a writing implement gripping aid to teach proper grip orientation, comprising:

(a) obtaining a gripping aid for a writing implement, said gripping aid comprising a tapered sleeve member having an external and an internal surface and a first open end and a second open end, wherein said tapered sleeve member is adapted to receive a writing implement there through and said second open end of said tapered sleeve member is dimensioned to retain the writing implement and second finger of a user therein; and a strap having a first end and a second end coupled to said tapered sleeve member, wherein said first end of said strap is coupled to said tapered sleeve member at said first open end and said second end of said strap is coupled to said tapered sleeve member at said second open end thereby defining an aperture between said strap and said tapered sleeve member, said aperture dimensioned to retain the third finger of a user therein, wherein said tapered sleeve member and said strap are oriented such that insertion of a writing instrument through the tapered sleeve member, insertion of the second finger of a user's hand into said second open end of said tapered sleeve member, placing the thumb of the user's hand upon the external surface of the gripping aid and inserting the third finger of the user's hand through said aperture defined by said strap to retain said third finger in said strap results in a proper writing grip;

(b) introducing the gripping aid over a writing implement; and (c) inserting the second finger of a user's hand into the second open end of the tapered sleeve member, placing the thumb of the user upon the external surface of the gripping aid, inserting the third finger through said aperture defined by said strap to retain said third finger in said strap.

10. A writing device comprising:

(a) a writing implement gripping aid for teaching proper grip orientation, comprising:

a tapered sleeve member, having an external and an internal surface and a first open end and a second open end, wherein said tapered sleeve member is adapted to receive a writing implement there through and said second open end of said tapered sleeve member is dimensioned to retain the writing implement and second finger of a user therein; and a strap having a first end and a second end coupled to said tapered sleeve member, wherein said first end of said strap is coupled to said tapered sleeve member at said first open end and said second end of said strap is coupled to said tapered sleeve member at said second open end thereby defining an aperture between said strap and said tapered sleeve member, said aperture dimensioned to retain the third finger of a user therein, wherein said tapered sleeve member and said strap are oriented such that insertion of a writing instrument through the tapered sleeve member, insertion of the second finger of a user's hand into said second open end of said tapered sleeve member, placing the thumb of the user's hand upon the external surface of the gripping aid and inserting the third finger of the user's hand through said aperture defined by said strap to retain said third finger in said strap results in a proper writing grip, and (b) a writing implement received through said first open end and said second open end of said tapered sleeve member.

11. A writing implement gripping aid for teaching proper grip orientation, comprising:

a tapered sleeve member, having an external and an internal surface and a first open end and a second open end, wherein said tapered sleeve member is adapted to receive a writing implement there through and said second open end of said tapered sleeve member is dimensioned to retain the writing implement and second finger of a user therein; and a strap having a first end and a second end coupled to said tapered sleeve member, wherein said first end of said strap is coupled to said tapered sleeve member at said first open end and said second end of said strap is coupled to said tapered sleeve member at said second open end thereby defining an aperture between said strap and said tapered sleeve member, said aperture dimensioned to retain the third finger of a user therein, wherein said tapered sleeve member and said strap are oriented such that insertion of a writing instrument through the tapered sleeve member, insertion of the second finger of a user's hand into said second open end of said tapered sleeve member, placing the thumb of the user's hand upon the external surface of the gripping aid and inserting the third finger of the user's hand through said aperture defined by said strap to retain said third finger in said strap results in a proper writing grip, wherein said gripping aid is comprised entirely of a flexible material.

* * * * *